US009932733B2

(12) United States Patent
Desautels et al.

(10) Patent No.: US 9,932,733 B2
(45) Date of Patent: Apr. 3, 2018

(54) SYSTEM AND METHOD FOR FASCIA HINGE CONNECTIONS

(71) Applicants: John Fredrick Desautels, Mill Creek, WA (US); Joel Douglas Skillingstead, Redmond, WA (US)

(72) Inventors: John Fredrick Desautels, Mill Creek, WA (US); Joel Douglas Skillingstead, Redmond, WA (US)

( * ) Notice: Subject to any disclaimer, the term of this patent is extended or adjusted under 35 U.S.C. 154(b) by 0 days.

(21) Appl. No.: 15/011,671

(22) Filed: Feb. 1, 2016

(65) Prior Publication Data

US 2016/0145849 A1 May 26, 2016

Related U.S. Application Data

(63) Continuation of application No. 14/121,351, filed on Aug. 21, 2014.

(51) Int. Cl.

| | |
|---|---|
| ***E04B 1/19*** | (2006.01) |
| ***E04H 12/22*** | (2006.01) |
| ***E04C 3/36*** | (2006.01) |
| ***E04B 1/00*** | (2006.01) |
| ***E04F 19/06*** | (2006.01) |
| ***E04B 1/58*** | (2006.01) |
| ***E04B 1/61*** | (2006.01) |

(52) U.S. Cl.

CPC ..... *E04B 1/1903* (2013.01); *E04B 1/003* (2013.01); *E04B 1/58* (2013.01); *E04B 1/6108* (2013.01); *E04C 3/36* (2013.01); *E04F 19/064* (2013.01); *E04H 12/2292* (2013.01); *E04B 2001/5868* (2013.01)

(58) Field of Classification Search

CPC ..... E04B 1/1903; E04B 1/003; E04B 1/58; E04B 1/6108; E04B 2001/5868; E04F 19/064; E04F 13/06; E04F 2013/063; E04F 19/022; E04F 19/061; E04F 13/0733; E04C 3/36; E04H 12/2292; E04H 12/2253

USPC ..... 52/650.3, 832, 834, 835, 272, 273, 281, 52/282.3, 287.1, 288.1

See application file for complete search history.

(56) References Cited

U.S. PATENT DOCUMENTS

| | | | | |
|---|---|---|---|---|
| 3,090,087 | A | 5/1963 | Miller | |
| 3,559,356 | A * | 2/1971 | Koral | E04F 19/028 248/345.1 |
| 4,189,885 | A | 2/1980 | Fritz | |
| 5,074,084 | A | 12/1991 | Kriss | |
| 5,090,174 | A * | 2/1992 | Fragale | E04C 2/292 52/276 |
| 5,459,969 | A | 10/1995 | Stibolt et al. | |
| 5,542,222 | A | 8/1996 | Wilson et al. | |
| 5,771,646 | A | 6/1998 | DeSouza | |
| 5,901,525 | A | 5/1999 | Doeringer et al. | |

(Continued)

*Primary Examiner* — Theodore V Adamos
(74) *Attorney, Agent, or Firm* — Bold IP, PLLC; Christopher Mayle; John Hauvener

(57) ABSTRACT

A decking system and method comprising a set of components that may be used for constructing and repairing structures, particularly the connection between fascia boards. The components may be shaped such that they fit together to form a connection between fascia boards at any angle while providing protective cover from the elements and a polished look. The components may be composed of a variety of materials and may be extruded. A decorative pattern, engraving, or embossing, or any of the above may be applied to the components as desired.

10 Claims, 9 Drawing Sheets

(56) References Cited

U.S. PATENT DOCUMENTS 5,916,101 A 6/1999 Stibold
6,141,928 A 11/2000 Platt
6,219,980 B1 * 4/2001 Peck, Jr. ..... E04F 19/028 52/255
6,886,296 B1 5/2005 John et al.
7,908,812 B2 3/2011 Eberle, III
7,926,226 B2 4/2011 Pope
8,033,066 B2 * 10/2011 Griffiths ..... E04F 13/081 52/235
8,091,500 B2 1/2012 Stroud
8,256,614 B1 9/2012 Wadsworth, Sr.
8,272,190 B2 9/2012 Schiffmann et al.
8,291,647 B2 10/2012 Esposito
8,322,097 B2 12/2012 Schiffmann et al.
8,371,556 B2 2/2013 Price
8,499,505 B2 8/2013 Pulte
8,516,777 B2 8/2013 Schiffmann et al.
8,714,887 B2 5/2014 Tipps et al.
8,739,489 B2 6/2014 Weber et al.
2003/0037495 A1 * 2/2003 Shaw ..... E04F 19/022 52/287.1
2003/0221373 A1 * 12/2003 Kim ..... E04D 13/0645 52/14
2005/0229531 A1 10/2005 Green et al.
2005/0284082 A1 12/2005 Smith
2006/0076545 A1 4/2006 Reynders et al.
2006/0260247 A1 * 11/2006 Monteer ..... E04F 13/0846 52/520
2007/0151180 A1 7/2007 Pace et al.
2008/0005984 A1 * 1/2008 Kampichler ..... E04F 19/022 52/254
2009/0056252 A1 * 3/2009 Taylor ..... E04F 19/061 52/287.1
2012/0328823 A1 * 12/2012 Monteer ..... B32B 21/02 428/99
2013/0111840 A1 5/2013 Bordener

* cited by examiner

SYSTEM AND METHOD FOR FASCIA HINGE CONNECTIONS

CROSS-REFERENCE TO RELATED APPLICATIONS

The present application is a continuation in part application which claims the benefit of U.S. Provisional Patent Application No. 61/959,379, filed on Aug. 22, 2013, entitled "Deck post attachment system," U.S. Provisional Patent Application No. 61/959,380, filed on Aug. 22, 2013, entitled "Fascia expansion cover connector," and U.S. Nonprovisional patent application Ser. No. 14/121,351, filed on Aug. 21, 2014, entitled "Enhanced deck assembly facilitation method and systems," and which are incorporated herein by reference in their entirety as if fully set forth herein.

FIELD OF THE DISCLOSURE

This disclosure relates generally to the field of methods and systems for securing the ends of fascia boards in the construction of gazebos or other standalone decking systems, decks adjoining a house, or other primary structure, or other such structures for walkways or human occupancy.

BACKGROUND

Wooden boards are a common material for constructing homes and other buildings. The wooden boards are cut to the desired size and shape and attached to each other to form walls, roofs, ceilings, floors, and other building surfaces. The fascia of a structure is the outermost part of the cornice of the structure. The fascia of a structure is often composed of fascia boards or horizontal trim that cover the joists. Fascia boards have an aesthetic function in that they create a smooth surface along the edge. Fascia boards are exposed to the weather and are often the first places on a house to be damaged from the elements. The weather also causes the fascia boards to expand and contract.

The ends of fascia boards are often nailed or screwed together during construction of the fascia of a building. The joint where two fascia boards meet is a common place for the fascia boards to rot, split, and bend. Over time these joints, fastened together by nails or screws, push away from each other, creating a crack between them. This causes an unsightly appearance but also can keep the fascia board from doing its job keeping the elements from penetrating the home's exterior. With enough movement of the boards and fascia, the heads of the nails and screws may break off. If not repaired the condition will continue to deteriorate until the nails or screws protrude completely out of the boards. Eventually the two fascia boards separate from each other, the wood of the fascia board gets dry rot, and the boards twist out of shape, putting stress on the adjacent board joints.

One solution is to replace the fascia boards, which can be expensive. However, when it is only the ends of the board that need replacing, another solution is to re-nail the boards together. This is only a temporary solution because nails alone are not adequate to contain the separation process between the fascia boards. In addition, each time the boards are nailed together the end of the board loses structural integrity due to the multiple nail holes.

For the forgoing reasons, there is a need for a fascia connection system that is easy to construct, protects the fascia board ends, allows for expansion and contraction of the fascia, and retains a long lasting look and finish.

Accordingly, a fascia hinge connection system is disclosed, which includes a fascia hinge connector system for securing the ends of two fascia boards, wherein the fascia hinge connector system secures the ends of fascia boards regardless of age or weather.

SUMMARY

The present invention relates to a system and method for constructing and repairing structures, particularly the connection between fascia boards. The system comprises three components—one center component and two of the same component (z-component)—that fit together to form a connection between fascia boards. The system also comprises a method which utilizes the system components to allow for ease of use and flexibility while providing for long lasting protection and a polished look.

The following embodiments and descriptions are for illustrative purposes only and are not intended to limit the scope of the System for Fascia Connections. Other aspects and advantages of the present disclosure will become apparent from the following detailed description.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure. Also, the drawings included herein are considered by the applicant to be informal.

Figure 1:
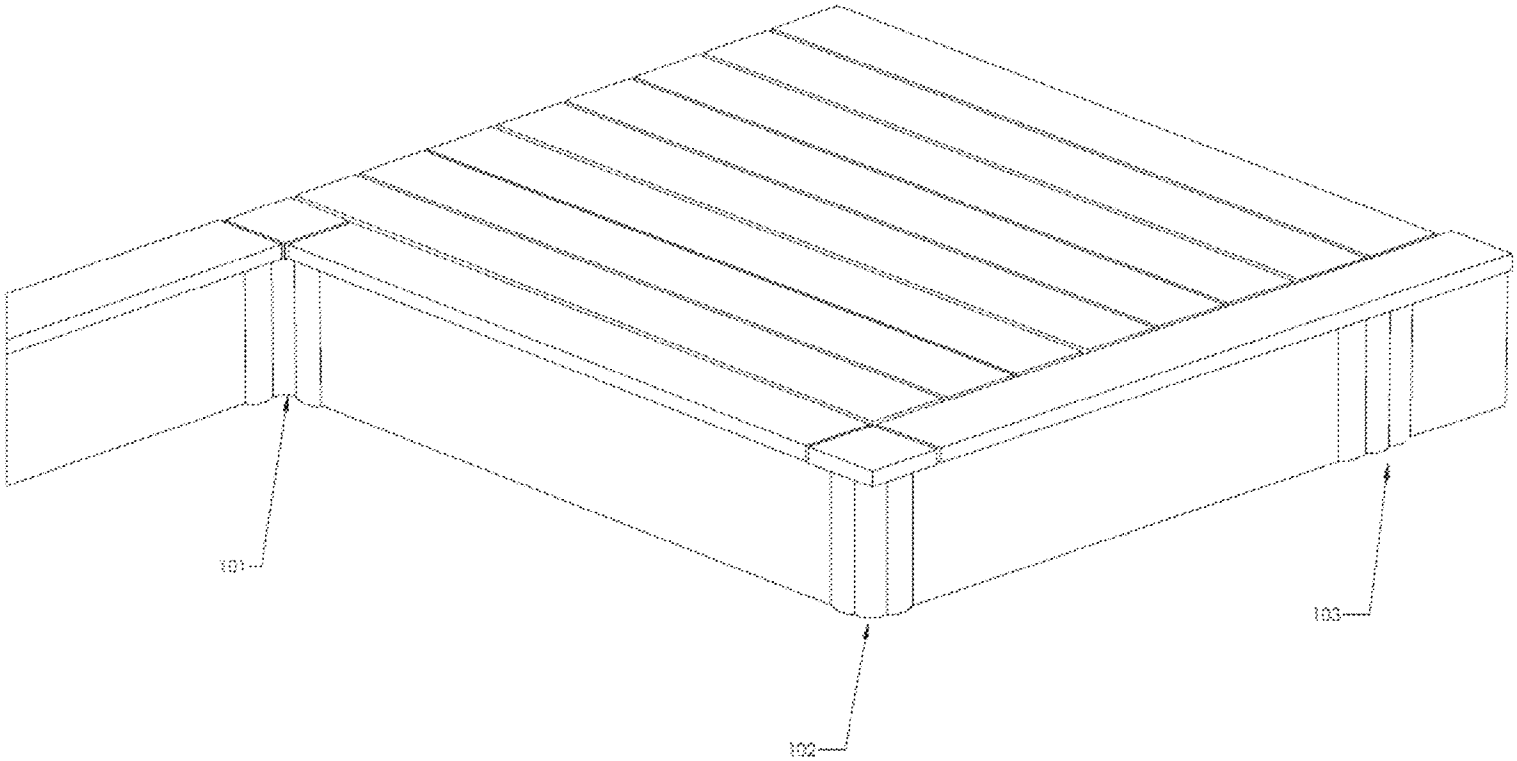
FIG. 1 is an exterior view of the fascia hinge connections at various angles.

all arranged in accordance with at least some embodiments of the present disclosure.

DETAILED DESCRIPTION

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)—(a second number)," this means a range whose limit is the second number. For example, 25 to 100 mm means a range whose lower limit is 25 mm and upper limit is 100 mm.

DEFINITIONS

Concave: Having an outline or surface that curves inward like the interior of a circle or sphere.

Convex: Having an outline or surface that curves like the exterior of a circle or sphere.

Extrusion: A process used to create objects of a fixed cross-sectional profile, where a material is pushed through a die of the desired cross-section.

Fascia Board: An architectural term for a horizontal band forming the outer surface of a cornice visible to an observer.

Fastener: A hardware device that mechanically joins or affixes two or more objects together.

Hinge Connector: The middle piece of the fascia hinge connection system described herein, which is the piece of the system that has a curved shape and is sandwiched between two z-component pieces.

Main Deck Board: The deck boards that make up the edge of the walking surface of the deck Obtuse Angle: An angle between a 90° angle and a 180° angle.

Reflex Angle: An angle larger than a 180° angle.

Z-Component: The "z" shaped components of the fascia hinge connection system described herein, which are the pieces of the system that are shaped like a "z" and sandwiches the hinge connector on either side.

The present disclosure is generally drawn, inter alia, to systems and methods therein relating to fascia hinge connections. In the preferred embodiments, a hinge connector is sandwiched between two z-components that secure the end of a fascia board on either side. The preferred embodiment has the pattern of fascia board, z-component, hinge connector, z-component, and then fascia board.

For example, in some embodiments, a first z-shaped component is fastened to a first main deck board and a second z-shaped component is fastened to a second main deck board, wherein the first and second main deck boards are connected together in some fashion at any angle, including 45° angle, 90° angle, 180° angle, and 270° angle. In between the first and second z-shaped components is a hinge connector that is held in place by the pressure from a first side by a first z-shaped component and a second side by a second z-shaped component. In the pocket formed between the first main deck board and the first z-component, a first fascia board is installed, and the pocket formed between the second main deck board and the second z-component, a second fascia board is installed. The pockets where the fascia board is installed allows for the z-components to cover the fascia board ends, functioning as a protective cover from the elements, and a smooth, aesthetically pleasing finish. The hinge connector also covers the connection between the main deck boards functioning as a protective cover from the elements, and a smooth, aesthetically pleasing finish. In addition, the unique shape and composition of the z-components sandwiching the hinge connector accommodates the varying pressure forced upon the hinge complex and the fascia boards caused by expansion and contraction of the raw deck material due to the sun, weather, and elements.

In some embodiments, the main deck boards, fascia boards, fasteners, z-components, and hinge connectors may be composed of material comprising wood, metal, plastic, or composites. Further, the main deck boards, fascia boards, fasteners, z-components, and hinge connectors may be made of differing materials. The components may be produced by an extrusion process.

In some embodiments, a decorative pattern may be applied to the hinge connectors and z-shaped components. A pattern, shape, or lettering may be carved into the outer surface of the hinge connectors and z-shaped components. In some embodiments, an engraving may be applied to the hinge connectors and z-components. Additionally, in some embodiments, an embossing may be applied to the hinge connectors and z-components.

FIG. 1 is an exterior view of the fascia hinge connections at various angles, arranged in accordance with at least some embodiments of the present disclosure. FIG. 1 includes an angle 101, an angle 102, and an angle 103. In FIG. 1, various angles of a deck are shown wherein the main deck boards are the longitudinal boards facing upwards or towards the top of the figure, the fascia boards are the outermost longitudinal boards facing the sides, the z-components and hinge connector are intersecting the fascia board to fascia board connections, and the deck trim are the parts intersecting the main deck boards and the fascia boards. At angle 101, the angle of the deck is at a 90° inside angle and also shown in FIG. 3. In angle 101, the hinge connector is laid in a fashion where the concave side faces the exterior of the deck. At angle 102, the angle of the deck is at a 90° outside angle and also shown in FIG. 4. In angle 102, the hinge connector is laid in a fashion where the concave side faces the deck. At angle 103, the angle of the deck is at a 180° angle and also shown in FIG. 7. In angle 103, the hinge connector is laid in a fashion where the concave side faces the deck.

Figure 2:
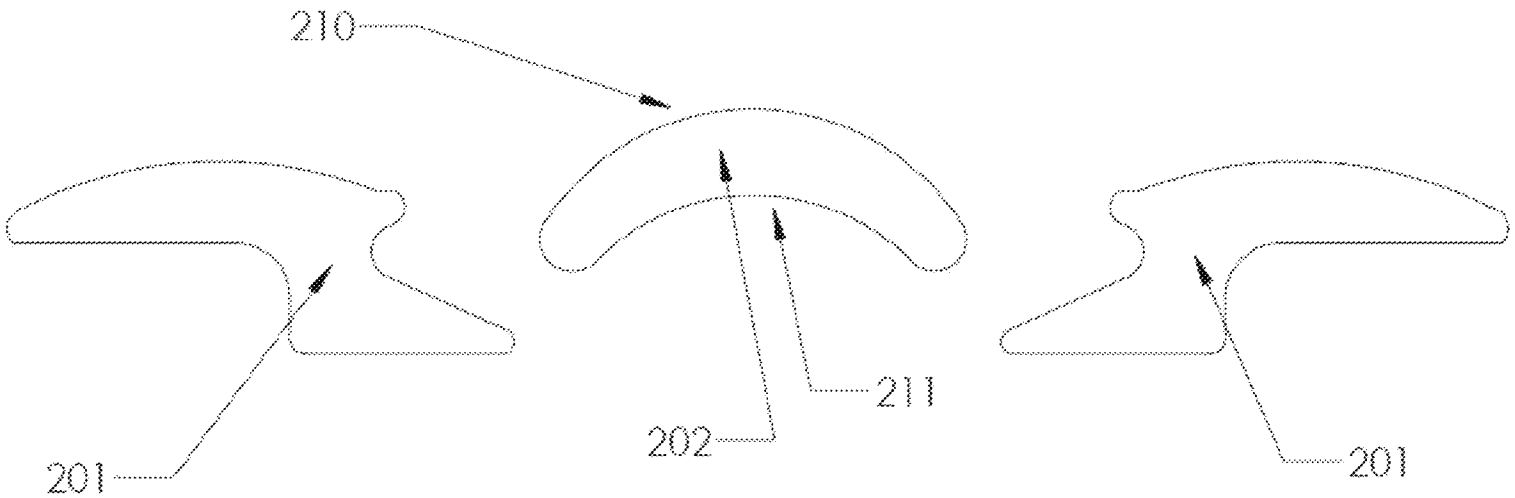
FIG. 2 is a diagram of the components of the fascia hinge connector system.

FIG. 2 is a diagram of the components of the fascia hinge connector system, arranged in accordance with at least some embodiments of the present disclosure. FIG. 2 includes a z-component 201, a hinge connector 202, a convex 210 side of hinge connector 202, and a concave 211 side of hinge connector 202. Z-component 201 is fashioned in a z-shape to create a pocket to accommodate a fascia board on one side, the left side as shown in the left z-component 201 of this figure, and to create a pocket to accommodate a hinge connector on the other side, the right side as shown in the left z-component 201 of this figure. To create the z-component, hinge connector, z-component sandwich, z-component 201 as shown in the left side of the figure would be on one side of the sandwich and z-component 201 rotated 180° about the vertical axis would be on the other side of the sandwich, as shown on the right side of the figure. Hinge connector 202 is symmetrical about the vertical axis. Hinge connector 202 may be rotated about the horizontal axis for installation in various angles. For example, the concave side 211 may face the exterior for 45° inside angle and 90° inside angles. Additionally, the convex side 210 may face the exterior for 45° outside angles, 90° outside angles, and straight or 180° angles.

Figure 3:
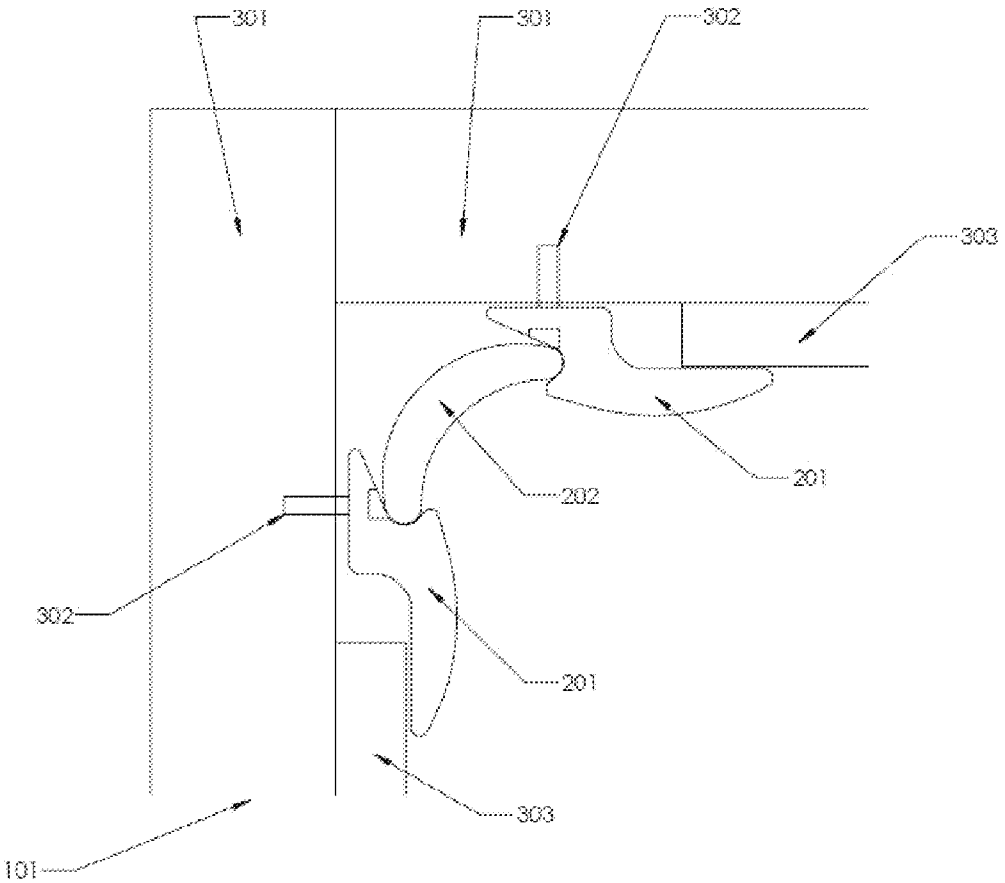
FIG. 3 is a top view diagram of the fascia hinge connection at a 90° inside angle.

FIG. 3 is a top view diagram of the fascia hinge connection at a 90° inside angle, arranged in accordance with at least some embodiments of the present disclosure. FIG. 3 includes a Main Deck Board 301, a Fastener 302, a Fascia Board 303, a Z-Component 201, and a Hinge Connector 202.

In FIG. 3, a top view diagram for a 90° inside angle is shown. This diagram is a close-up example of how the decking parts interconnect and the flexibility and ease of use of the decking parts. In this 90° inside angle diagram, there are two Main Deck Board 301*s* that are installed at a 90° inside angle. A first Z-Component 201 is fastened to a first Main Deck Board 301 with a first Fastener 302, and a second Z-Component 201 is fastened to a second Main Deck Board 301 with a second Fastener 302. In between the two Z-Component 201*s* is one Hinge Connector 202, which is held in place by the pressure exerted on either side by the two z-components. In the pocket formed between the first Main Deck Board 301 and the first Z-Component 201, a first Fascia Board 303 is installed, and in the pocket formed between the second Main Deck Board 301 and the second Z-Component 201, a second Fascia Board 303 is installed. The pockets where the fascia boards are installed allows for the z-components to cover the fascia board ends, functioning as a protective cover from the elements, and a smooth, aesthetically pleasing finish. The hinge connector also covers the connection between the main deck boards functioning as a protective cover from the elements, and a smooth, aesthetically pleasing finish. In addition, the unique shape and composition of the z-components sandwiching the hinge connector accommodates the varying pressure forced upon the hinge complex and the fascia boards caused by expansion and contraction of the raw deck material due to the sun, weather, and elements.

Figure 4:
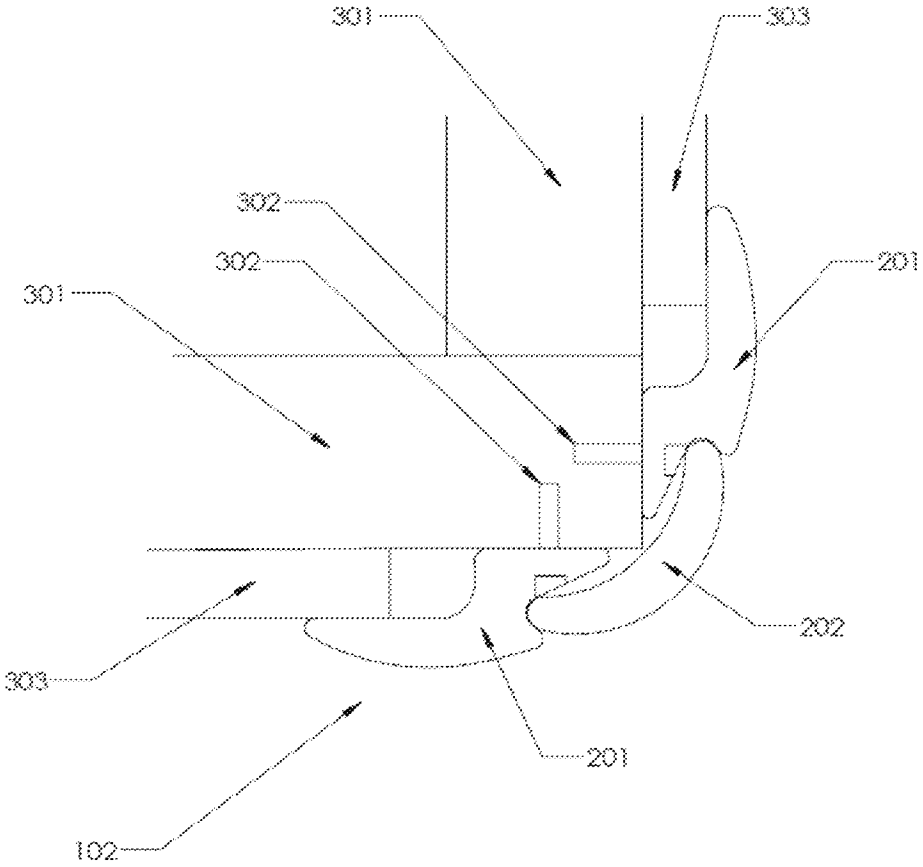
FIG. 4 is a top view diagram of the fascia hinge connection at a 90° outside angle.

FIG. 4 is a top view diagram of the fascia hinge connection at a 90° outside angle, arranged in accordance with at least some embodiments of the present disclosure. FIG. 4 includes a Main Deck Board 301, a Fastener 302, a Fascia Board 303, a Z-Component 201, and a Hinge Connector 202.

In FIG. 4, a top view diagram for a 90° outside angle is shown. This diagram is a close-up example of how the decking parts interconnect and the flexibility and ease of use of the decking parts. In this 90° outside angle diagram, there are two Main Deck Board 301*s* that are installed at a 90° outside angle. A first Z-Component 201 is fastened to a first Main Deck Board 301 with a first Fastener 302, and a second Z-Component 201 is fastened to a second Main Deck Board 301 with a second Fastener 302. In between the two Z-Component 201*s* is one Hinge Connector 202, which is held in place by the pressure exerted on either side by the two z-components. In the pocket formed between the first Main Deck Board 301 and the first Z-Component 201, a first Fascia Board 303 is installed, and in the pocket formed between the second Main Deck Board 301 and the second Z-Component 201, a second Fascia Board 303 is installed. The pockets where the fascia boards are installed allows for the z-components to cover the fascia board ends, functioning as a protective cover from the elements, and a smooth, aesthetically pleasing finish. The hinge connector also covers the connection between the main deck boards functioning as a protective cover from the elements, and a smooth, aesthetically pleasing finish. In addition, the unique shape and composition of the z-components sandwiching the hinge connector accommodates the varying pressure forced upon the hinge complex and the fascia boards caused by expansion and contraction of the raw deck material due to the sun, weather, and elements.

Figure 5:
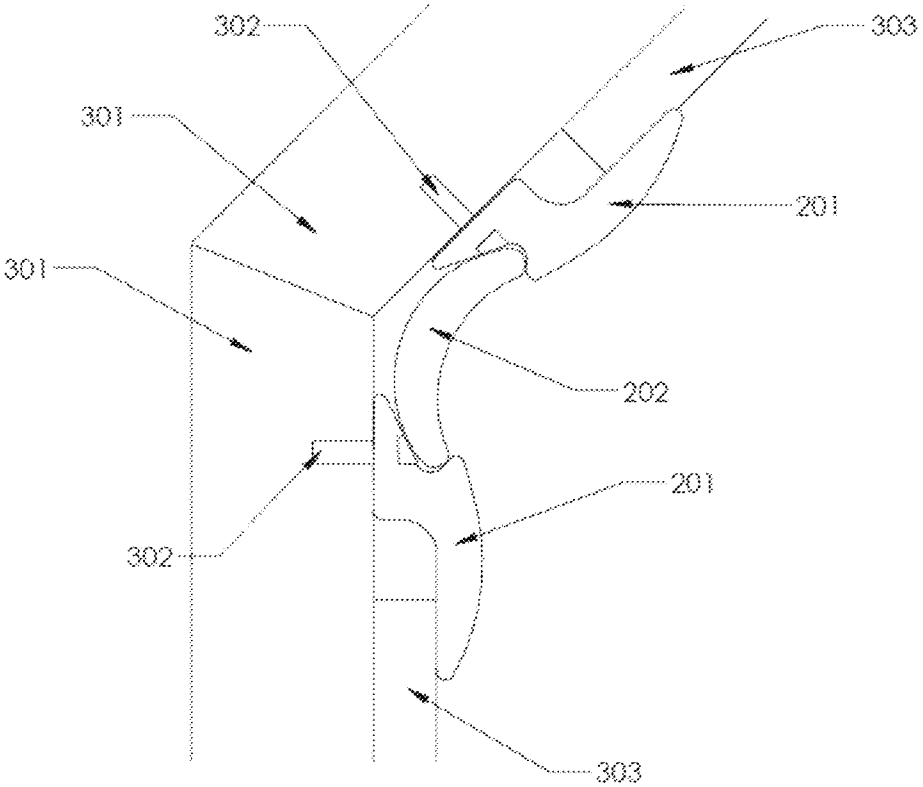
FIG. 5 is a top view diagram of the fascia hinge connection at a 45° inside angle.

FIG. 5 is a top view diagram of the fascia hinge connection at a 45° inside angle, arranged in accordance with at least some embodiments of the present disclosure. FIG. 5 includes a Main Deck Board 301, a Fastener 302, a Fascia Board 303, a Z-Component 201, and a Hinge Connector 202.

In FIG. 5, a top view diagram for a 45° inside angle is shown. This diagram is a close-up example of how the decking parts interconnect and the flexibility and ease of use of the decking parts. In this 45° inside angle diagram, there are two Main Deck Board 301*s* that are installed at a 45° inside angle. A first Z-Component 201 is fastened to a first Main Deck Board 301 with a first Fastener 302, and a second Z-Component 201 is fastened to a second Main Deck Board 301 with a second Fastener 302. In between the two Z-Component 201*s* is one Hinge Connector 202, which is held in place by the pressure exerted on either side by the two z-components. In the pocket formed between the first Main Deck Board 301 and the first Z-Component 201, a first Fascia Board 303 is installed, and in the pocket formed between the second Main Deck Board 301 and the second Z-Component 201, a second Fascia Board 303 is installed. The pockets where the fascia boards are installed allows for the z-components to cover the fascia board ends, functioning as a protective cover from the elements, and a smooth, aesthetically pleasing finish. The hinge connector also covers the connection between the main deck boards functioning as a protective cover from the elements, and a smooth, aesthetically pleasing finish. In addition, the unique shape and composition of the z-components sandwiching the hinge connector accommodates the varying pressure forced upon the hinge complex and the fascia boards caused by expansion and contraction of the raw deck material due to the sun, weather, and elements.

Figure 6:
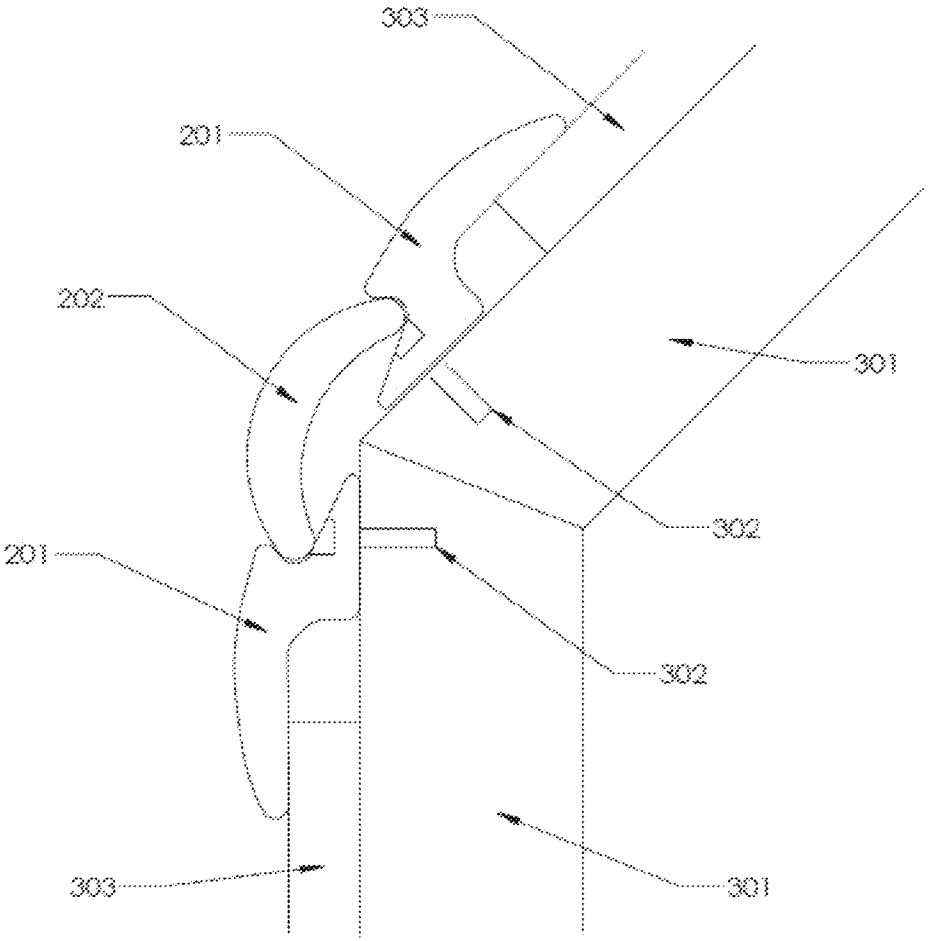
FIG. 6 is a top view diagram of the fascia hinge connection at a 45° outside angle.

FIG. 6 is a top view diagram of the fascia hinge connection at a 45° outside angle, arranged in accordance with at least some embodiments of the present disclosure. FIG. 5 includes a Main Deck Board 301, a Fastener 302, a Fascia Board 303, a Z-Component 201, and a Hinge Connector 202.

In FIG. 6, a top view diagram for a 45° outside angle is shown. This diagram is a close-up example of how the decking parts interconnect and the flexibility and ease of use of the decking parts. In this 45° outside angle diagram, there are two Main Deck Board 301*s* that are installed at a 45° outside angle. A first Z-Component 201 is fastened to a first Main Deck Board 301 with a first Fastener 302, and a second Z-Component 201 is fastened to a second Main Deck Board 301 with a second Fastener 302. In between the two Z-Component 201*s* is one Hinge Connector 202, which is held in place by the pressure exerted on either side by the two z-components. In the pocket formed between the first Main Deck Board 301 and the first Z-Component 201, a first Fascia Board 303 is installed, and in the pocket formed between the second Main Deck Board 301 and the second Z-Component 201, a second Fascia Board 303 is installed. The pockets where the fascia boards are installed allows for the z-components to cover the fascia board ends, functioning as a protective cover from the elements, and a smooth, aesthetically pleasing finish. The hinge connector also covers the connection between the main deck boards functioning as a protective cover from the elements, and a smooth, aesthetically pleasing finish. In addition, the unique shape and composition of the z-components sandwiching the hinge connector accommodates the varying pressure forced upon the hinge complex and the fascia boards caused by expansion and contraction of the raw deck material due to the sun, weather, and elements.

Figure 7:
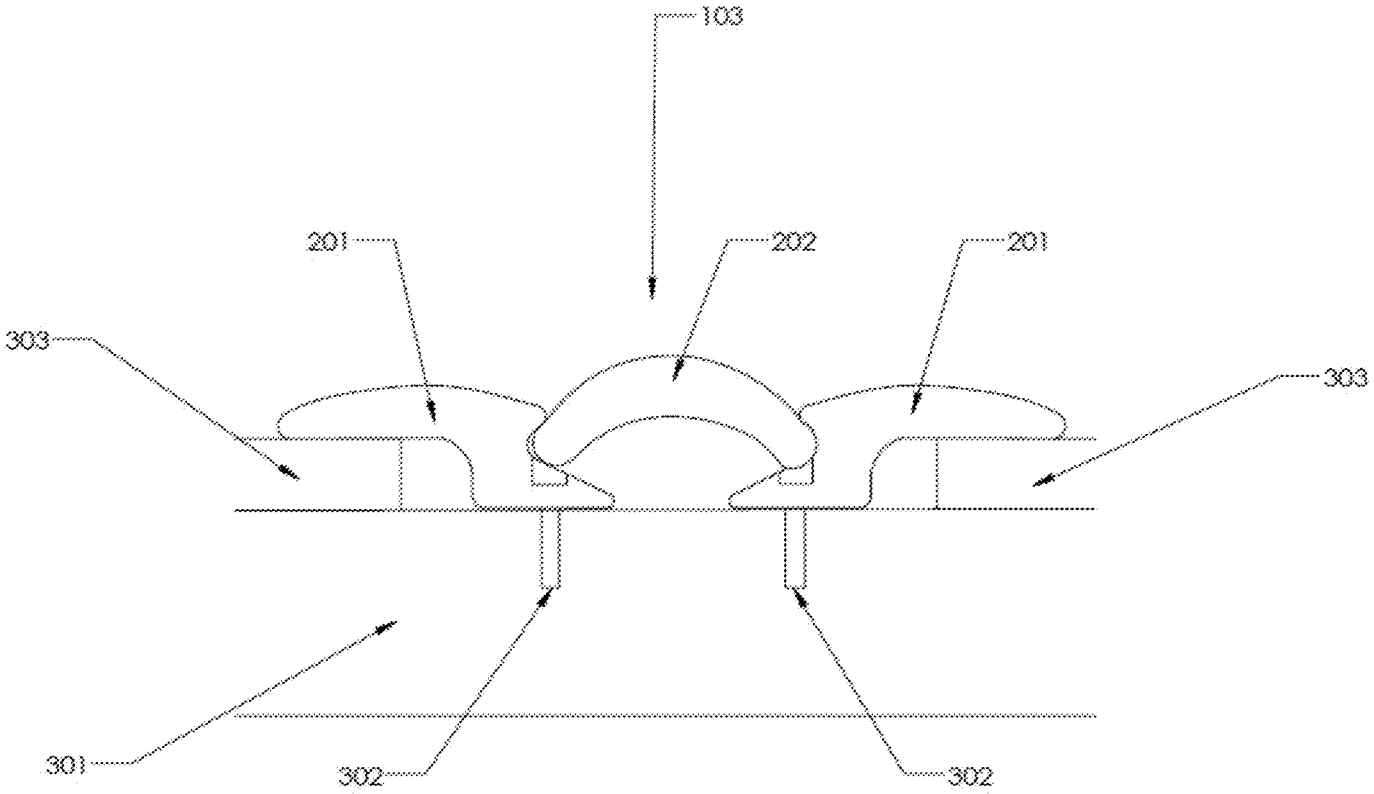
FIG. 7 is a top view diagram of the fascia hinge connection at a straight (or) 180° angle.

FIG. 7 is a top view diagram of the fascia hinge connection at a straight or 180° angle, arranged in accordance with at least some embodiments of the present disclosure. FIG. 7 includes a Main Deck Board 301, a Fastener 302, a Fascia Board 303, a Z-Component 201, and a Hinge Connector 202.

In FIG. 7, a top view diagram for a straight or 180° angle is shown. This diagram is a close-up example of how the decking parts interconnect and the flexibility and ease of use of the decking parts. In this straight or 180° angle diagram, Main Deck Board 301 may be a single main deck board or two main deck boards installed at a straight or 180° angle. A first Z-Component 201 is fastened to a first Main Deck Board 301 with a first Fastener 302, and a second Z-Component 201 is fastened to the same Main Deck Board 301 or a second Main Deck Board 301 with a second Fastener 302. In between the two Z-Component 201*s* is one Hinge Connector 202, which is held in place by the pressure exerted on either side by the two z-components. In the pocket formed between the first Main Deck Board 301 and the first Z-Component 201, a first Fascia Board 303 is installed, and in the pocket formed between the same Main Deck Board 301 or the second Main Deck Board 301 and the second Z-Component 201, a second Fascia Board 303 is installed. The pockets where the fascia boards are installed allows for the z-components to cover the fascia board ends, functioning as a protective cover from the elements, and a smooth, aesthetically pleasing finish. The hinge connector also covers the connection between the main deck boards functioning as a protective cover from the elements, and a smooth, aesthetically pleasing finish. In addition, the unique shape and composition of the z-components sandwiching the hinge connector accommodates the varying pressure forced upon the hinge complex and the fascia boards caused by expansion and contraction of the raw deck material due to the sun, weather, and elements.

Figure 8:
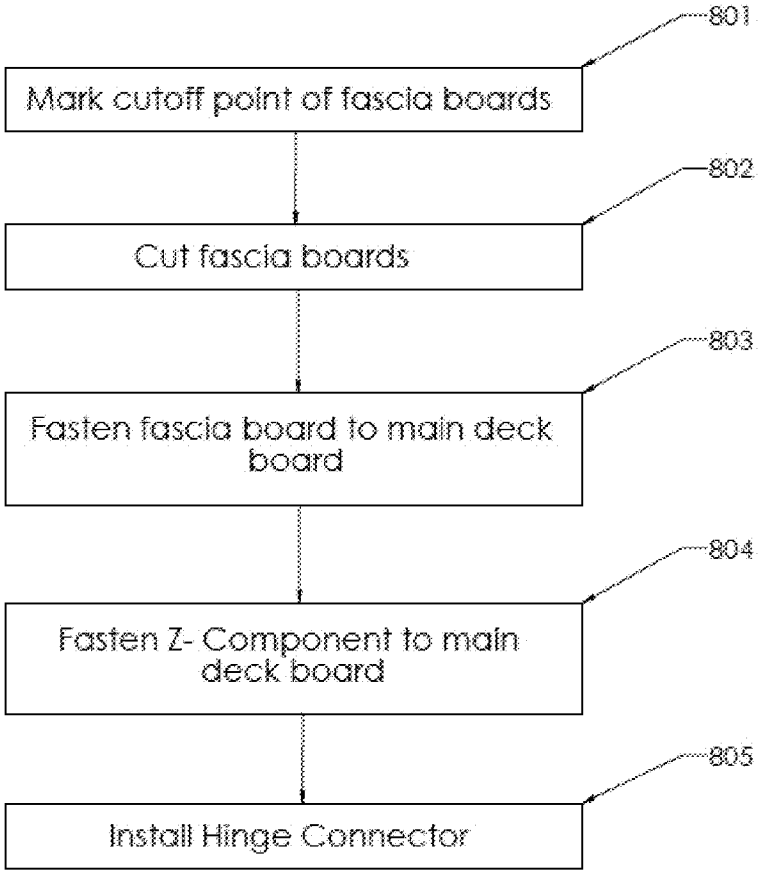
FIG. 8 is a flow diagram of the method to install the fascia hinge connector system.

FIG. 8 is a flow diagram of the method to install the fascia hinge connector system. FIG. 8 includes a step 801, a step 802, a step 803, a step 804, and a step 805.

In FIG. 8, a flow diagram outlining the method steps to install the fascia hinge connector system is shown. In step 801, the cutoff point of a fascia board is marked with a plastic or cardboard template, shown in FIG. 9. Without a template, an installer would simply measure off the equal distance from each corner; the distance may vary slightly depending on the inside and outside corners and degree of angle. Step 801 is done for the fascia boards to be installed on the left and the right of hinge connector system. In step 802, the installer would cut the fascia boards where marked. Regardless of the angle the hinge connector system is to be installed, the installer may disregard the angle at which to cut because the end of the fascia board is hidden and fastened by z-component 201 and there is sufficient space in the pocket where the fascia board fits in the z-component to expand and contract.

In step 803, the fascia boards that have been measured and cut are fastened to a main deck board with a screw, nail, or braid as per typical spacing except at the end where the hinge connector system will be attached. The ends of the fascia boards would not be fastened down as the hinge connector system, more specifically the z-components, will provide the function of fastening down the end of the fascia board.

In step 804, z-component 201 is fastened to the main deck board. Z-component 201 is arranged in a fashion where the overhang on z-component 201 fastens down on top of the end of the fascia board. Step 804 is done for both fascia boards that will be connected with the hinge connector system. In step 805, hinge connector 202 is installed by popping or hammering into position hinge connector 202 in the space between the two z-components. Hinge connector 202 conceals the fasteners on the z-components installed in step 804. Depending on how tight the hinge connection is, no fastener may be needed to keep hinge connector 202 in position. While a hidden fastener is preferred, hinge connector 202 may be fastened through the front with screws, nails, or braids as there is very little structural stress on the connector itself. Because there is little or no stress on hinge connector 202, all three pieces of the hinge connector system may be completely attached using braids or screws, eliminating the need to hammer the hinge connector 202 into place.

For replacing parts, the hinge connector system in most cases may be left installed because it is designed to allow the fascia boards to easily expand and contract behind the overlapping edge of the z-components. Hinge connector 202 may be removed in a reversal of the installation process outlined and detailed in FIG. 8. Fasteners, such as nailing and braids would make removal a bit more problematic but would still in most instances be removable via a pry bar. More than likely, hinge connector 202 would be reusable but also could be replaced with a new hinge connector 202.

Figure 9:
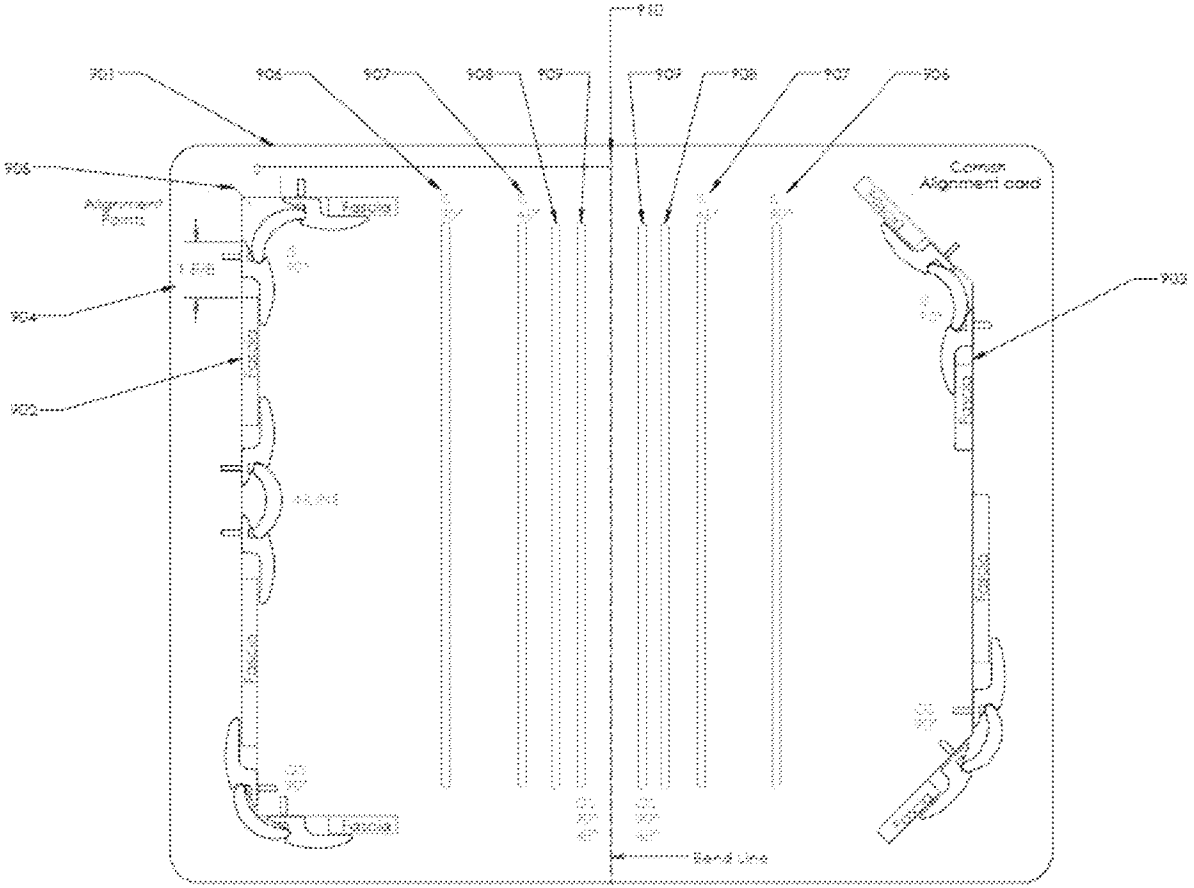
FIG. 9 is an embodiment of a template for marking the cutoff point for fascia boards.

FIG. 9 is an embodiment of a template for marking the cutoff point for fascia boards. FIG. 9 includes an alignment card 901, an angle guide 902, an angle guide 903, a distance setting 904, an alignment point 905, a cutoff point 906, a cutoff point 907, a cutoff point 908, a cutoff point 909, and a bend line 910.

In FIG. 9, an embodiment of a template for marking the cutoff point for fascia boards is shown. The template or alignment card 901 may be made of material such as plastic or cardboard. Along the left perimeter of alignment card 901 is angle guide 902, which labels and shows an example inside (IS) 90° angle, inline or 180° angle, and outside (OS) 90° angle. Along the right perimeter of alignment card 901 is angle guide 903, which labels and shows an example inside (IS) 45° angle and outside (OS) 45° angle. Alignment point 905 shows an example on IS 90° angle where alignment card 901 would be positioned for hinge connection system installment. Bend line 910 would be placed on the building structure as shown at alignment point 905 to mark cutoff points on fascia boards at cutoff points 906. Distance setting 904 sets the distance between the z-component end and fascia at one and five eighths (1⅝) inches. Similarly, bend line 910 placed on a building structure for an inside 45° angle would mark cutoff points on fascia boards at cutoff points 907. Similarly, bend line 910 placed on a building structure for an inline or 180° angle would mark cutoff points on fascia boards at cutoff points 908. Similarly, bend line 910 placed on a building structure for an outside 45° angle or an outside 90° angle would mark cutoff points on fascia boards at cutoff points 909.

While preferred and alternate embodiments have been illustrated and described, as noted above, many changes can be made without departing from the spirit and scope of the System for Fascia Connections. Accordingly, the scope of the System for Fascia Connections is not limited by the disclosure of these preferred and alternate embodiments. Instead, the scope of the System for Fascia Connections should be determined entirely by reference to the claims. Insofar as the description above and the accompanying drawings (if any) disclose any additional subject matter that is not within the scope of the claims below, the inventions are not dedicated to the public and Applicant hereby reserves the right to file one or more applications to claim such additional inventions.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. §112 ¶6. In particular, the use of "step of" in the claims herein is not intended to invoke the provisions of U.S.C. §112 ¶916.

The invention claimed is:

1. A decking system comprising:

a hinge connector, having a curved body with a first end and a second end opposite the first end;

a first fascia board;

a second fascia board;

a first main deck board having a first aperture to accept a first fastener and a second main deck board having a second aperture to accept a second fastener, wherein the first fascia board is installable on a side of the first main deck board and the second fascia board is installable on a side of the second main deck board;

a first z-shaped component, having a first defined concave receptacle portion interfacing with the first fascia board, a second defined concave receptacle portion interfacing with the hinge connector and the first main deck board, and an aperture through the second defined concave receptacle portion to accept the first fastener;

a second z-shaped component, having a first defined concave receptacle portion interfacing with the second fascia board, a second defined concave receptacle portion interfacing with the hinge connector and the second main deck board, and an aperture through the second defined concave receptacle portion to accept the second fastener, wherein the first defined concave receptacle of the first z-shaped component receives and holds the first fascia board, wherein the first z-shaped component overlaps with an end of the first fascia board, wherein the first defined concave receptacle of the first z-shaped component accommodates the first fascia board as the first fascia board expands or contracts, wherein the first defined concave receptacle of the second z-shaped component receives and holds the second fascia board, wherein the second z-shaped component overlaps with an end of the second fascia board, wherein the first defined concave receptacle of the second z-shaped component accommodates the second fascia board as the second fascia board expands or contracts, wherein the first fastener extends through the aperture of the first z-shaped component and the first aperture of the first main deck board to secure the first z-shaped component to the first main deck board, wherein the second fastener extends through the aperture of the second z-shaped component and the second aperture of the second main deck board to secure the second z-shaped component to the second main deck board, and wherein the second defined concave receptacle portion of the first z-shaped component receives and holds the first end of the hinge connector and the second defined receptacle portion of the second z-shaped component receives and holds the second end of the hinge connector, wherein the hinge connector is held by pressure between the second defined concave receptacle portion of the first z-shaped component and the second defined concave receptacle portion of the second z-shaped component.

2. The decking system of claim 1, wherein the first and second fascia boards are installed at a 45° inside angle.

3. The decking system of claim 1, wherein the first and second fascia boards are installed at a 90° outside angle.

4. The decking system of claim 1, wherein the first and second fascia boards are installed at a 90° inside angle.

5. The decking system of claim 1, wherein the first and second fascia boards are installed at a 90° outside angle.

6. The decking system of claim 1, wherein the first and second fascia boards are installed at a straight or 180° angle.

7. The decking system of claim 1, wherein the hinge connector and the first and second z-shaped components are comprised of wood, metal, plastic, or composites.

8. The decking system of claim 1, wherein a decorative pattern is applied to the hinge connector and the first and second z-shaped components.

9. The decking system of claim 1, wherein an engraving is applied to the hinge connector and the first and second z-shaped components.

10. The decking system of claim 1, wherein an embossing is applied to the hinge connector and the first and second z-shaped components.

* * * * *